US008292254B2

(12) United States Patent
Groepler

(10) Patent No.: US 8,292,254 B2
(45) Date of Patent: Oct. 23, 2012

(54) METHOD FOR HANGING PARTY FAVORS AND APPARATUS AND KITS RELATED THERETO

(76) Inventor: Elizabeth A. Groepler, Kentfield, CA (US)

( * ) Notice: Subject to any disclaimer, the term of this patent is extended or adjusted under 35 U.S.C. 154(b) by 289 days.

(21) Appl. No.: 12/608,866

(22) Filed: Oct. 29, 2009

(65) Prior Publication Data

US 2011/0260021 A1 Oct. 27, 2011

(51) Int. Cl.
*A47G 29/00* (2006.01)
*F16M 11/00* (2006.01)

(52) U.S. Cl. ..... 248/683; 248/205.3; 248/205.4

(58) Field of Classification Search ..... 248/683, 248/205.3, 205.4
See application file for complete search history.

(56) References Cited

U.S. PATENT DOCUMENTS

| | | | | |
|---|---|---|---|---|
| 3,909,968 | A | 10/1975 | Bolstad | |
| 4,715,841 | A | 12/1987 | Nelson et al. | |
| 4,798,554 | A | 1/1989 | Nelson et al. | |
| 4,884,987 | A | 12/1989 | Mason | |
| 4,895,545 | A | 1/1990 | Nelson | |
| 4,936,532 | A | 6/1990 | Williams | |
| 4,944,709 | A | 7/1990 | Lovik | |
| 5,004,633 | A | 4/1991 | Lovik | |
| 5,011,447 | A | 4/1991 | Watanabe | |
| 5,390,889 | A | 2/1995 | Hiscock | |
| 5,823,365 | A | 10/1998 | Page | |
| 5,938,154 | A * | 8/1999 | Bartels | 248/176.1 |
| 5,989,093 | A | 11/1999 | Nelson et al. | |
| 6,375,534 | B1 | 4/2002 | Burns | |
| 6,523,798 | B1 | 2/2003 | Novak | |
| 6,569,521 | B1 | 5/2003 | Sheridan et al. | |
| 6,575,806 | B1 | 6/2003 | Nelson et al. | |
| 6,716,083 | B1 * | 4/2004 | Castro | 446/220 |
| 6,969,295 | B1 | 11/2005 | Sidwell | |
| 7,078,093 | B2 | 7/2006 | Sheridan et al. | |
| 7,195,117 | B2 * | 3/2007 | Vitye | 206/77.1 |
| 7,276,272 | B2 | 10/2007 | Mizuno et al. | |
| 7,284,734 | B2 | 10/2007 | Hamerski | |
| 7,540,456 | B2 * | 6/2009 | Thompson | 248/205.3 |
| 7,594,636 | B2 * | 9/2009 | Wong | 248/497 |
| 2003/0177680 | A1 | 9/2003 | Sender | |
| 2004/0198146 | A1 | 10/2004 | Murray et al. | |
| 2009/0068632 | A1 | 3/2009 | Thompson et al. | |

FOREIGN PATENT DOCUMENTS

| | | |
|---|---|---|
| GB | 2379619 | 3/2003 |
| GB | 2424376 A | 9/2006 |
| GB | 2447608 | 9/2008 |
| WO | WO 03/000369 A1 | 1/2003 |

OTHER PUBLICATIONS

International Search Report issued Feb. 22, 2011 in PCT/US2010/54342.

* cited by examiner

*Primary Examiner* — Amy J. Sterling
(74) *Attorney, Agent, or Firm* — Pillsbury Winthrop Shaw Pittman LLP

(57) ABSTRACT

The present inventions relate to a balloon and streamer hub assembly that allows for the efficient hanging of balloons and streamers in a variety of different environments, as well as kits and methods related thereto. In one aspect, the balloon and streamer hub assembly includes a mounting block, and adhesive member a bowl shaped cover, and a securing mechanism for attachment of the bowl-shaped cover to the mounting block. The bowl-shaped has a depth that substantially corresponds to the width of the mounting block, and further includes a plurality of holes disposed around edges thereof in predetermined positions, which are adapted for attachment thereto different ones of the balloons and streamers.

21 Claims, 12 Drawing Sheets

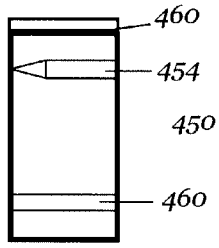
Fig 10(c)
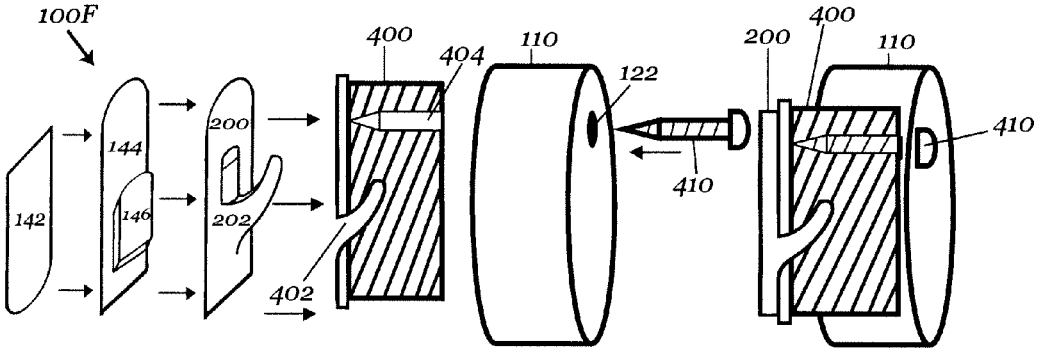
Fig 10(a)
Fig 10(b)

METHOD FOR HANGING PARTY FAVORS AND APPARATUS AND KITS RELATED THERETO

FIELD OF THE INVENTION

The present invention relates to a method for hanging party favors, and more particularly a balloon and streamer hub assembly that allows for the efficient hanging of balloons and streamers in a variety of different environments, as well as kits and methods related thereto.

BACKGROUND

It is well known to hang party favors, such as streamers and balloons, typically indoors, but also outside. One conventional manner is to fill balloons up with air and tie them, and thereafter using single-sided tape to affix the balloons and streamers to a wall, ceiling or other structure, typically with the balloons in different clusters, and the streamers hanging between different clusters of balloons. Usage of such tape is known as being unsightly, results in significant variation between clusters of different balloons used in arrangements, and can end up taking significant amounts of time to complete. And once completed, in many instances parts or all of the arrangements can then fall down—even at the most inappropriate times.

There are various different apparatus that have been proposed to overcome different aspects of the problems addressed above.

UK Patent Application 2379619 uses an arrangement of apertures and associated slots within a clip that allows for a more uniform configuration of balloons, as well as allegedly provides a tight seal that doesn't require the knotting of a balloon. The clip contains a mounting hole that receives either an attachment member (such as a nail) or a string that can be used to hang the assembly.

U.S. Pat. No. 4,936,532 and GB2447608 each provide different yet similar arrangements as taught in the UK Patent Application 2379619 mentioned above, but instead each use a sticky tape to mount the hanger device/balloon holder to the ceiling, wall or other surface.

It is also known to use 3M Command® strips, which strips are made in accordance with U.S. Pat. Nos. 6,569,521; 7,276,272; and 7,284,734. It is known to use these Command® strips to hang articles, and then remove the Command® strips in a way that prevents the adhesive itself from sticking to the ceiling, wall or other surface, as well as to tie strings to the balloons, and then tie the strings to a Command® strip.

Each of the above improvements offers advantages to using conventional single-sided, but none provide for an overall system that allows for the efficient hanging of balloons and streamers in a variety of different environments.

SUMMARY

The present inventions relate to a balloon and streamer hub assembly that allows for the efficient hanging of balloons and streamers in a variety of different environments, as well as kits and methods related thereto.

In one aspect, the balloon and streamer hub assembly includes an adhesive mount, an adhesive member, a bowl shaped cover, and a securing mechanism for attachment of the bowl-shaped cover to the adhesive mount. The bowl-shaped has a depth into which an end of the articles is inserted so that they are hidden from view, and further includes a plurality of holes disposed around edges thereof in predetermined positions, for insertion of the articles, such as balloons and streamers, which are adapted for attachment thereto different ones of the balloons and streamers.

In a preferred embodiment, the balloon and streamer hub assembly includes an adhesive as used in the 3M Command® strips, and can optionally include an alternate mounting mechanism, such as a hole or plurality of holes on the adhesive mount, for alternate attachment using a string or a nail.

In another aspect is provided a kit, which kit everything needed to hang balloons and streamers in an overall arrangement, which kit includes a plurality of the above-mentioned balloon and streamer hub assemblies, balloons, streamers, and optionally string, scissors and/or themed cover-face plates.

In a further aspect is described a method of hanging the balloons and streamers using the above-described balloon and streamer hub assembly.

BRIEF DESCRIPTION OF THE DRAWINGS

These and other aspects and features of the present invention will become apparent to those of ordinary skill in the art upon review of the following description of specific embodiments of the invention in conjunction with the accompanying figures, wherein:

FIG. 2(*c*) illustrates a preferred embodiment of packaging a balloon and streamer hub assembly kit according to the present invention;

FIG. 5(*c*) illustrates one embodiment of a balloon and streamer hub assembly;

FIG. 5(*d*) illustrates a partial component and perspective view of the balloon and streamer hub assembly illustrated in FIG. 5(*c*);

FIG. 5(*e*) illustrates an alternate hub assembly cover mounting block for usage in the embodiment illustrated in FIG. 5(*c*) above;

FIG. 6(*c*) illustrates another embodiment of a balloon and streamer hub assembly;

FIG. 6(*d*) illustrates a partial component and perspective view of the balloon and streamer hub assembly illustrated in FIG. 6(*c*);

FIG. 7(*b*) illustrates a backside of the hub assembly cover mounting bracket used in the balloon and streamer hub assembly illustrated in FIG. 7(*a*);

FIG. 7(*c*) illustrates an alternate hub assembly cover mounting block for usage in the embodiment illustrated in FIG. 7(*a*) above;

FIG. 8(*b*) illustrates a partial component and perspective view of the balloon and streamer hub assembly illustrated in FIG. 8(*a*);

FIG. 10(*a*) illustrates a further embodiment of a balloon and streamer hub assembly;

FIG. 10(*b*) illustrates a backside of the hub assembly cover mounting bracket used in the balloon and streamer hub assembly illustrated in FIG. 10(*a*);

FIG. 10(*c*) illustrates an alternate hub assembly cover mounting block for usage in the embodiment illustrated in FIG. 10(*a*) above;

DETAILED DESCRIPTION OF THE PREFERRED EMBODIMENTS

Described herein is a balloon and streamer hub assembly kit, and components thereof, usable for creating a decorative arrangement of clustered balloons and interconnected streamers.

Figure 1:
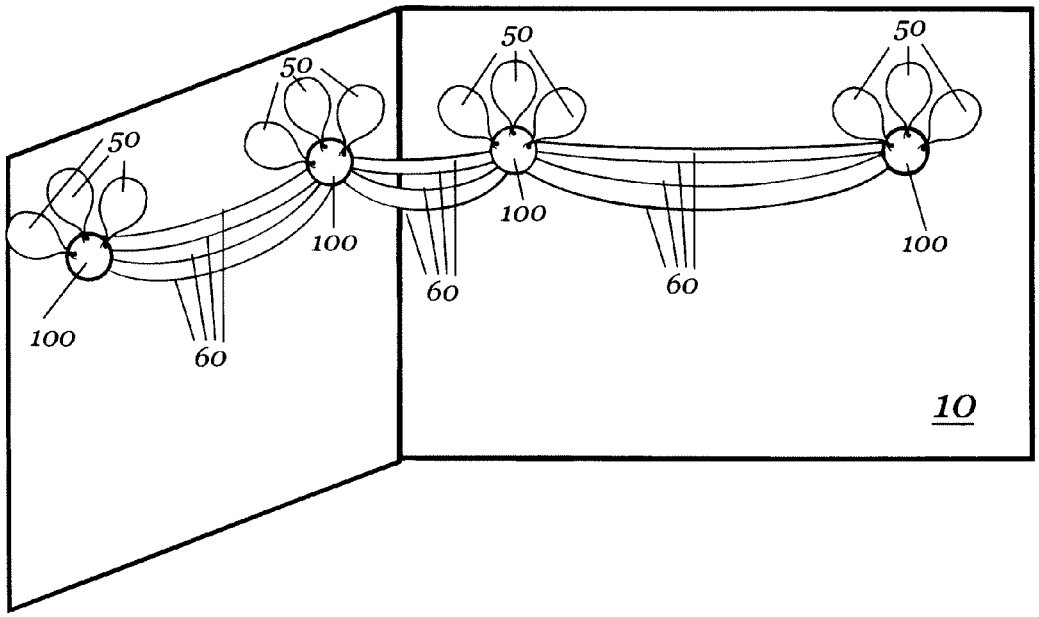
FIG. 1 illustrates a perspective view of a completed decorative arrangement using the a balloon and streamer hub assembly kit according to the present invention.

FIG. 1 illustrates a perspective view of a completed decorative arrangement using a balloon and streamer hub assembly kit 30 according to the present invention. Shown attached to wall 10 are four different balloon and streamer hub assemblies 100, with balloons 50 and streamers 60 suspended from each of the balloon and streamer hub assemblies 100, in a manner that will be described further hereinafter.

Figure 2A:
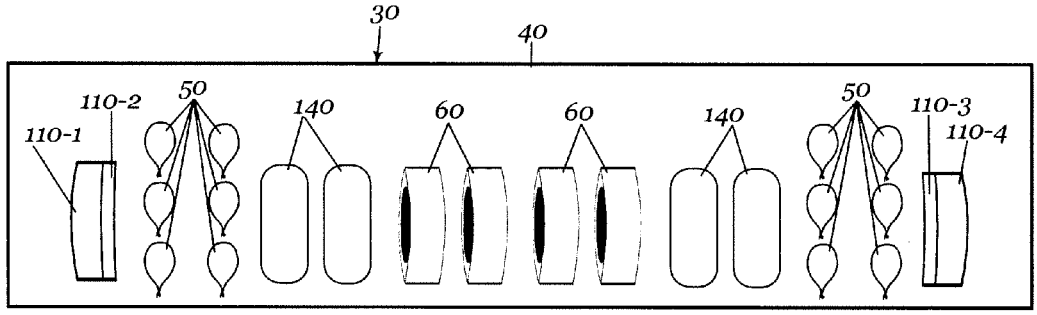
FIG. 2(*a*)-(*b*) illustrate different embodiments of balloon and streamer hub assembly kits according to the present invention.
Figure 2B:
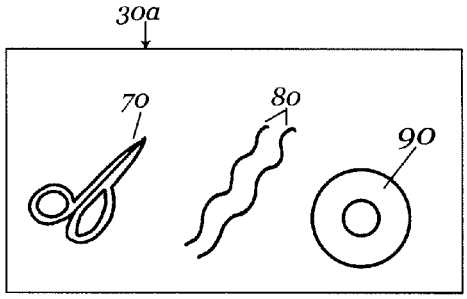
Figure 2C:
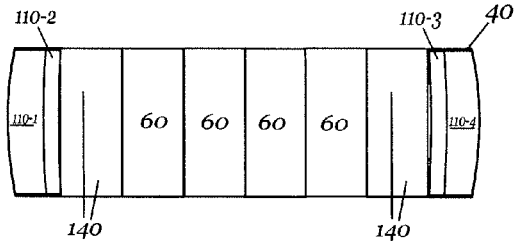

FIG. 2(*a*)-(*b*) illustrate different embodiments of balloon and streamer hub assembly kits according to the present invention. The balloon and streamer hub assembly kit 30 illustrated in FIG. 2(*a*) includes a packaging material 40, preferably transparent plastic, that is used to contain each of the components described therein within a small compact space, and in a manner in which the streamers will not be damaged, as also shown in FIG. 2(*c*). A illustrated, at each end, with the cover portion preferably directed inward at each end, are a pair of balloon and streamer hub assembly covers 110-1, 110-2 on one end, and 110-3 and 110-4 on the other end, with, therebetween, there being disposed mounting assemblies 140 (described further hereinafter), balloons 50, and streamers 60, as shown. With the streamers 60 located within the middle of the packaging, and protected by the streamer hub assembly covers 110-1, 110-2 on one end, and 110-3 and 110-4 on the other end, there is less potential for them to be damaged in transit.

Alternatively, as shown in FIG. 2(*b*), a kit 30*a* can further include scissors 70, string 80, and/or tape 90, which tape can be single sided, double sided, or can be both.

Figure 3A:
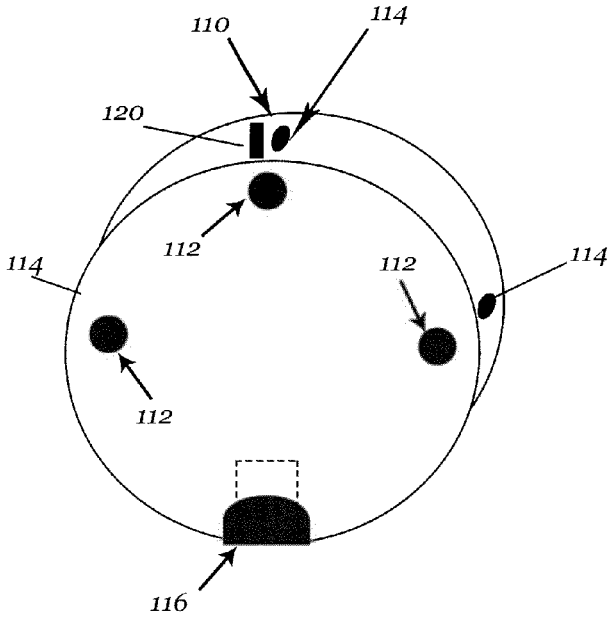
FIGS. 3(*a*)-(*b*) illustrate different perspective views of a preferred embodiment of a hub assembly cover according to the present invention.
Figure 3B:
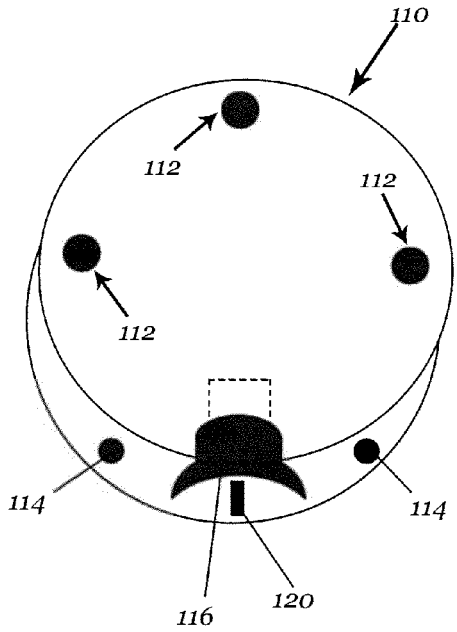

FIGS. 3(*a*)-(*b*) illustrate different perspective views of a preferred embodiment of a hub assembly cover 110 according to the present invention. For this embodiment, as shown, there are included balloon holes or slits 112 on the front face of the hub assembly cover 110, balloon holes or slits 114 on a side surface of the hub assembly cover 110, streamer end opening 116 on a side bottom surface of the hub assembly cover 110 and also mounting slits 120 on a side surface of the hub assembly cover 110, which mounting slits are preferably 180° apart from each other, their function being described further hereinafter.

The hub assembly cover is made of thin molded plastic, and, as described in the embodiment, is bowl shaped, thereby having a depth that will allow the end of the balloons 50 and steamers 60, as well as the mounting assembly 140, to be hidden from view and present a clean appearance.

In the embodiment shown in FIGS. 3(*a*)-(*b*), the cover is mounted to the mounting assembly 140 using the slits 120. Such slits are used in certain, but not all, embodiments as described hereinafter.

Figure 4A:
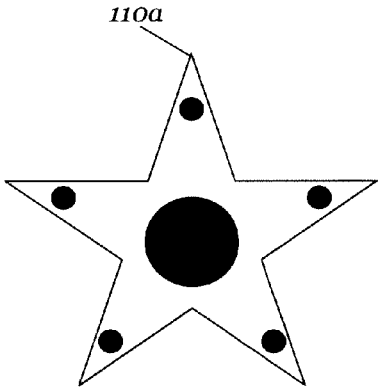
FIGS. 4(*a*)-(*c*) illustrate front view of different shaped hub assembly covers according to the present invention.
Figure 4B:
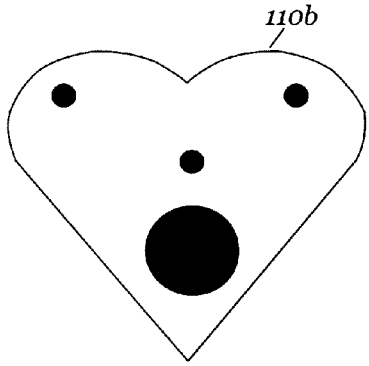
Figure 4C:
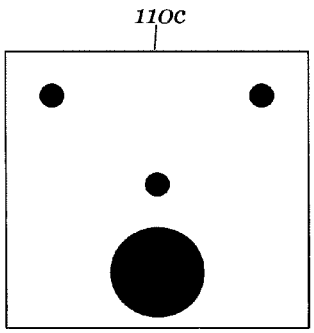

FIGS. 4(*a*)-(*c*) illustrate front view of different shaped hub assembly covers 110*a*, 110*b* and 110*c*, respectively according to the present invention. In each of these embodiments, the cover will preferably have a depth that that will allow the end of the balloons 50 and streamers 60, as well as the mounting assembly 140, to be hidden from view and present a clean appearance. Not shown are the slits 120 or other holes used to mount there different shaped hub assembly covers to the mounting assembly, but their use is understood and is apparent in light of the descriptions provided herein.

Figure 5C:
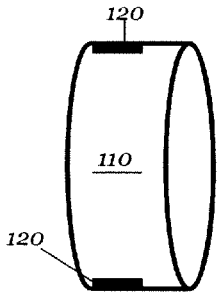
FIGS. 5(*a*(1-3) and (*b*)1-2 illustrates a hub assembly cover and a hub assembly cover mounting bracket for one embodiment of a balloon and streamer hub assembly.
Figure 5C:
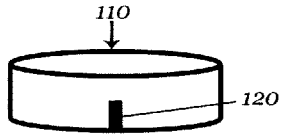
Figure 5C:
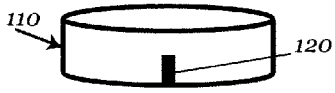
Figure 5C:
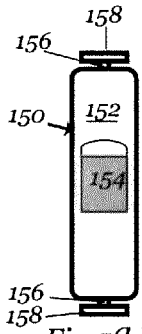
Figure 5C:
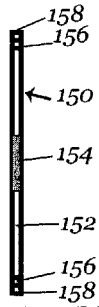
Figure 5C:
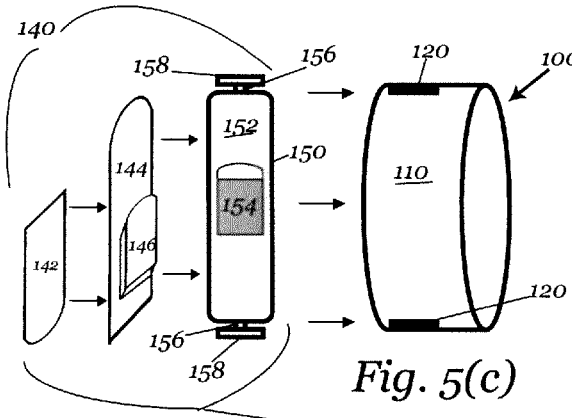

FIGS. 5*a*(1-3) and (*b*)1-2 illustrates a hub assembly cover 110 and a hub assembly cover mounting bracket 150 for one embodiment of a balloon and streamer hub assembly.

FIGS. 5*a*(1-3) of the hub assembly cover 110 as shown in perspective side, top and bottom views, with the mounting slits 120 being shown. The holes/slits for balloons and streamers are not shown for ease of this description, both in these and subsequent figures illustrating the hub assembly cover.

Figure 5:
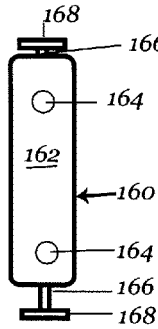
Figure 5D:
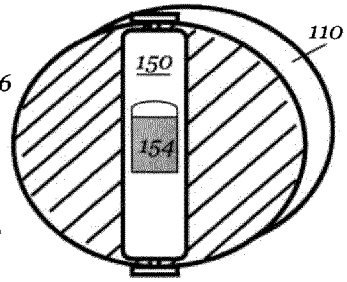
Figure 6C:
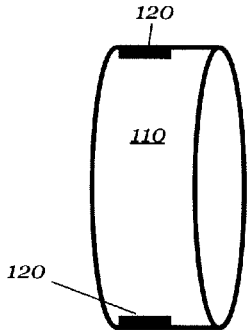
FIGS. 6(*a*)1-3 and (*b*)1-2 illustrates a hub assembly cover and a hub assembly cover mounting bracket for another embodiment of a balloon and streamer hub assembly.
Figure 6C:
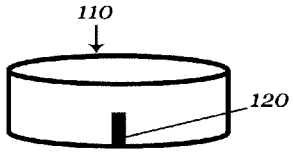
Figure 6C:
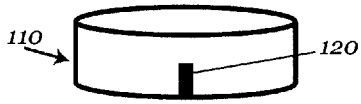
Figure 6C:
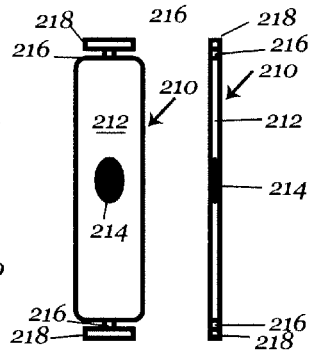
Figure 6C:
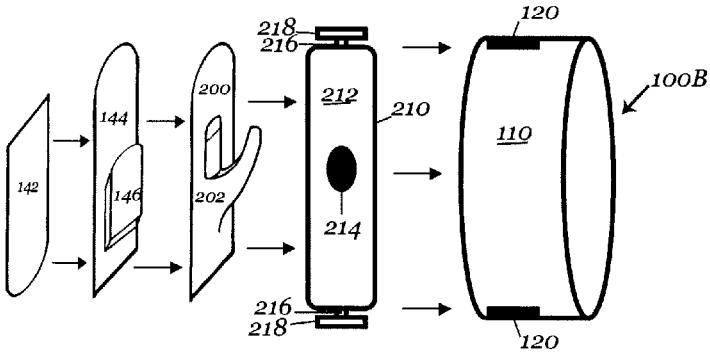
Figure 6D:
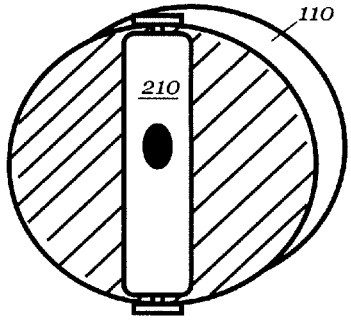

FIGS. 5 (*b*)1-2 illustrate hub assembly cover mounting bracket 150 in back and side views, which is made preferably from single-piece plastic. As shown in the back view of FIG. 5*b*(1), a recess 154 exists in the main body 152, which recess 154 is used for establishing a connection to a tab 146 associated with the adhesive mounting block 144 illustrated in FIG. 5(*c*). Also included are two cover tabs 158, which connect to a main body 152 of the bracket 150 via an extender 156.

FIG. 5(*c*) illustrates one embodiment of a balloon and streamer hub assembly 100A, and the various components that connect together to form one of the balloon and streamer hub assemblies 100A, namely an adhesive 142, a adhesive mounting block 144, the hub assembly cover mounting bracket 150 and the hub assembly cover 110. Adhesive 142 is either a 2-sided adhesive tape, or more preferably a Command® strip made by 3M®. Adhesive mounting block 144 is unitary plastic piece on which both the adhesive 142 is applied on a back surface, and which contains a tab 146 that allows interconnection into the recess 154 of the cover mounting bracket 150. Adhesive mounting block 144, in this embodiment, is preferably a Command® strip base made by 3M®. For the preferred embodiment in which the Command® strip and the Command® strip base made by 3M® are used, these are made in accordance with U.S. Pat. Nos. 6,569,521; 7,276,272; and 7,284,734, which patents are hereby each expressly incorporated by reference herein. The adhesive 142 thus attaches the back surface of the tape mount, as well as to the wall 50 as shown in FIG. 1, or alternatively a ceiling or other structure that allows the adhesive 142 to stick with sufficient strength.

FIG. 5(*d*) illustrates a partial component and perspective view of the balloon and streamer hub assembly 100A illustrated in FIG. 5(*c*), and in particular the attachment of the cover mounting bracket 150 to the hub assembly cover 110 in which the extenders 156 are each inserted into one of the slits 120 of the hub assembly cover 110, such that the cover tabs 158 keep the cover mounting bracket 150 sufficiently firmly attached to the hub assembly cover 110.

FIG. 5(*e*) illustrates an alternate hub assembly cover adhesive mount 160 (also referred to as a bracket or also just an adhesive mount) for usage in the embodiment illustrated in FIG. 5(*c*) above, which adhesive mount 160 is a single piece construction, preferably plastic, that has a backside to which the adhesive 142 attaches. There also exist two cover tabs 168, which connect to a main body 162 of the adhesive mount 160 via an extender 166, which are made the same as and function in the manner that the tabs 158 and extenders 156 described previously. This hub assembly cover adhesive mount 160 can be used in conjunction with an adhesive 142 that is a Command® strip made by 3M®. Also shown as part of the hub assembly cover adhesive mount 160 are two optional holes 164, which holes 164 can be used to tie a string through, or drive a nail or screw through, if an alternative attachment mechanism to the adhesive 142 is desired.

FIGS. 6(*a*)1-3 and (*b*)1-2 illustrates a hub assembly cover 110 and a hub assembly cover mounting block 210 for another embodiment of a balloon and streamer hub assembly. The hub assembly cover 110 is the same as illustrated in FIGS. 5(*a*)1-3, and as such will not be further described.

FIGS. 6 (*b*)1-2 illustrate hub assembly cover mounting bracket 210 in back and side views, which is made preferably from single-piece plastic. As shown in the back view of FIG. 6*b*(1), a hole 214 exists in the main body 212, which hole 214 is used for establishing a connection to a hook 212 associated with the hook mount 200 illustrated in FIG. 6(*c*). Also included are two cover tabs 218, which connect to the main body 212 of the bracket 210 via extenders 216, which are made the same as and function in the manner that the tabs 158 and extenders 156 described previously.

FIG. 6(*c*) illustrates this embodiment of a balloon and streamer hub assembly 100B, and the various components that connect together to form one of the balloon and streamer hub assemblies 100B namely the adhesive 142, a adhesive mounting block 144 and the hub assembly cover 110, which are the same as described in the FIG. 5(*c*) embodiment as such are similarly identified, and not further described. Different is that the hook mount 200, which is preferably a Command® hook made by 3M®, is further used to attach to the adhesive mounting block 144, and the hub assembly cover mounting bracket 210, described above, attaches to the hook mount 200 at the hook 202.

FIG. 6(*d*) illustrates a partial component and perspective view of the balloon and streamer hub assembly 100B illustrated in FIG. 6(*c*), and in particular the attachment of the cover mounting bracket 210 to the hub assembly cover 110 in which the extenders 216 are each inserted into one of the slits 120 of the hub assembly cover 110, such that the cover tabs 218 keep the cover mounting bracket 210 sufficiently firmly attached to the hub assembly cover 110.

Figures 7A, 7B, 7C:
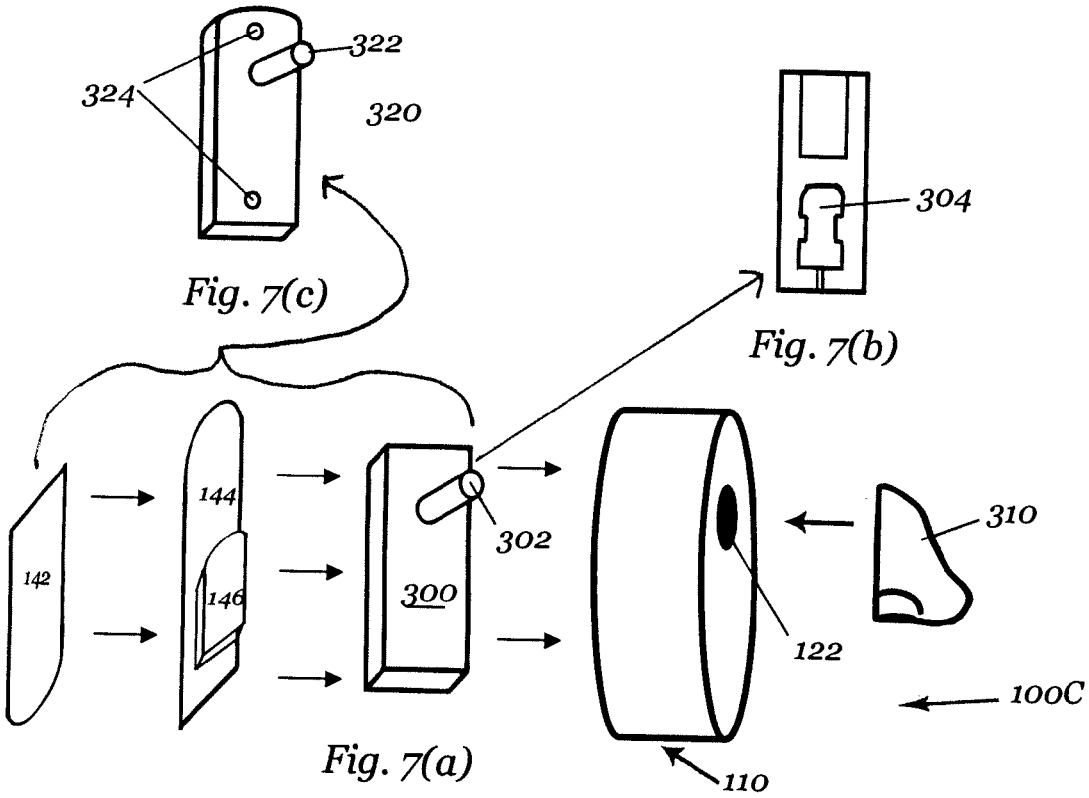
FIG. 7(*a*) illustrates a further embodiment of a balloon and streamer hub assembly.

FIG. 7(*a*) illustrates a further embodiment of balloon and streamer hub assembly 100C, and the various components that connect together to form one of the balloon and streamer hub assemblies 100C namely the adhesive 142, and a adhesive mounting block 144 that are the same as described in the FIG. 5(*c*) embodiment as such are similarly identified, and not further described. One difference from previous embodiments is that the hub assembly cover 110, instead of using the slits 120 instead have a hole 122 that is illustrated. Also different from previous embodiments is a cover mounting block 300 that includes a threadable bolt 302, which bolt 302 inserts through the hole 122 in the hub assembly cover 110, and then a bold 310, which can be configured with artwork and/or in a shape (such as the nose illustrated), is used to firmly attach the hub assembly cover to the cover mounting block 300. A backside of the cover mounting block 300 is shown in FIG. 7(*b*), and contains a recess 304 that is used to connect to the tab 146 of the adhesive mounting block 144, as described in previous embodiments.

FIG. 7(*c*) illustrates an alternate hub assembly cover mounting block 320 for usage in the embodiment illustrated in FIG. 7(*a*) above, which mounting block 320 is a single piece construction, preferably plastic, that has a backside to which the adhesive 142 attaches. There also exists a projecting bolt 322 that functions identically as the bolt 302 described with reference to FIG. 7(*b*). This hub assembly cover mounting block 320 can be used in conjunction with an adhesive 142 that is a Command® strip made by 3M®. Also shown as part of the hub assembly cover mounting block 160 are two optional holes 324, which holes 324 can be used to tie a string through, or drive a nail or screw through, if an alternative attachment mechanism to the adhesive 142 is desired.

Figure 8A:
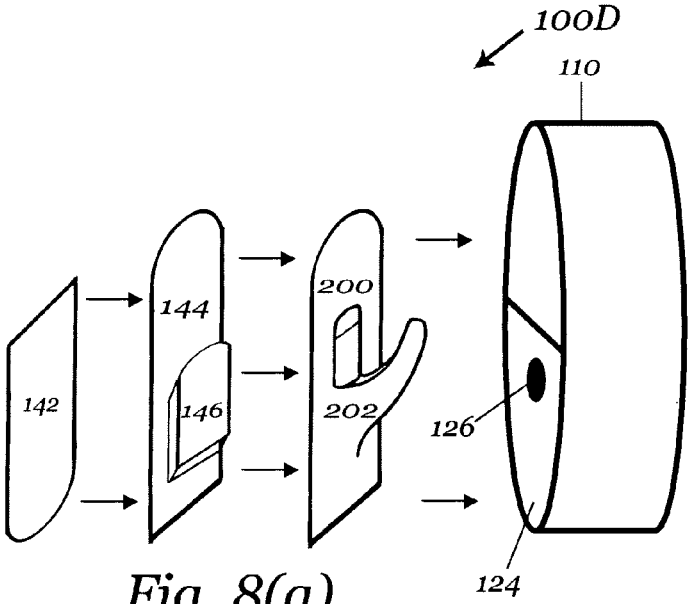
FIG. 8(*a*) illustrates a further embodiment of a balloon and streamer hub assembly.
Figure 8B:
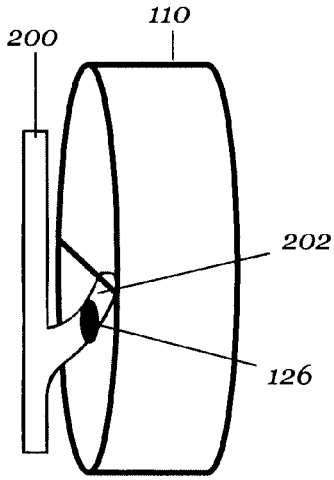

In another embodiment, the projecting bolt can be fashioned to look like a hook, such as hook 202 shown in FIG. 8(*a*), and the hook can then insert into a hole formed in the cover 110, such as the hole 126 shown in FIG. 8(*a*).

FIG. 8(*a*) illustrates a further embodiment of balloon and streamer hub assembly 100D and the various components that connect together to form one of the balloon and streamer hub assemblies 100D namely the adhesive 142, adhesive mounting block 144 and the hook mount 200 that are identical to the components previously described and illustrated with reference to FIG. 6(*c*). Different from previous embodiments in this embodiment is that the hook 202 inserts into a hole 126 that exists on a backside piece 124 of the hub assembly cover 110, instead of the slits 120 or the hole 122 previously used.

FIG. 8(*b*) illustrates a partial component and perspective view of the balloon and streamer hub assembly 100D illustrated in FIG. 8(*a*), and in particular illustrates the hood inserted into the hole 126 in order to attach the hub assembly cover 110 to the hook mount 200.

Figure 9:
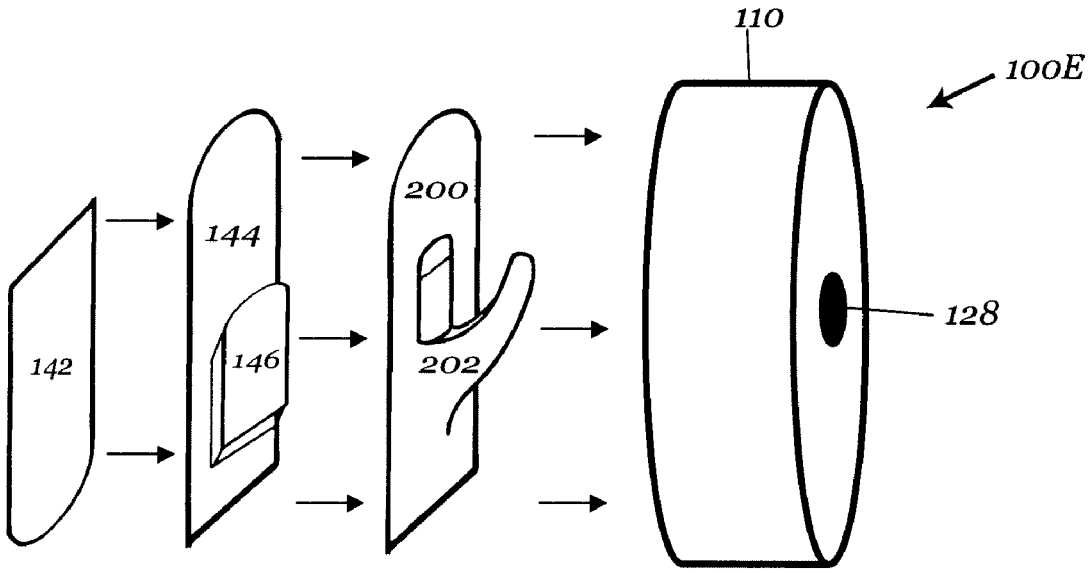
FIG. 9 illustrates another embodiment of a balloon and streamer hub assembly.

FIG. 9 illustrates another embodiment of a balloon and streamer hub assembly 100E, and the various components that connect together to form one of the balloon and streamer hub assemblies 100E namely the adhesive 142, adhesive mounting block 144 and the hook mount 200 that are identical to the components previously described and illustrated with reference to FIG. 6(*c*). Different from previous embodiments in this embodiment is that the hook 202 inserts into a hole 128 that exists on a front side of the hub assembly cover 110.

FIG. 10(*a*) illustrates a further embodiment of balloon and streamer hub assembly 100F, and the various components that connect together to form one of the balloon and streamer hub assemblies 100F, namely the adhesive 142, adhesive mounting block 144 and the hook mount 200 that are identical to the components previously described and illustrated with reference to FIG. 6(*c*), and the hub assembly cover 110 that is the same as that used in the FIG. 7(*a*) embodiment. Different from previous embodiments in this embodiment is that the inclusion of a mounting block 400 that contains a hook insertion member 402 that causes the mounting block to firmly mount to the hook mount 200, and the inclusion of a thread 404 into which the bolt 410 is inserted, as shown, to attach the hub assembly cover 110. FIG. 10(*b*) illustrates the connected hook mount 200, mounting block 400 and hub assembly cover 110. It is noted that the depth of the hub assembly cover 110 is preferably at least as deep at the width of the adhesive mounting block 144, hook mount 200 and mounting block 400.

FIG. 10(*c*) illustrates an alternate hub assembly cover mounting block 450 for usage in the embodiment illustrated in FIG. 10(*a*) above, which mounting block 450 replaces the adhesive mounting block 144, hook mount 200 and mounting block 400. A backside of the hub assembly cover mounting block 450 receives the adhesive 142, and the hole 454 is threaded to receive the bolt 410 illustrated in FIG. 10(*a*). Also shown as part of the hub assembly cover mounting block 450 are two optional holes 460, which holes 460 can be used to tie a string through, or drive a nail or screw through, if an alternative attachment mechanism to the adhesive 142 is desired.

Figure 11:
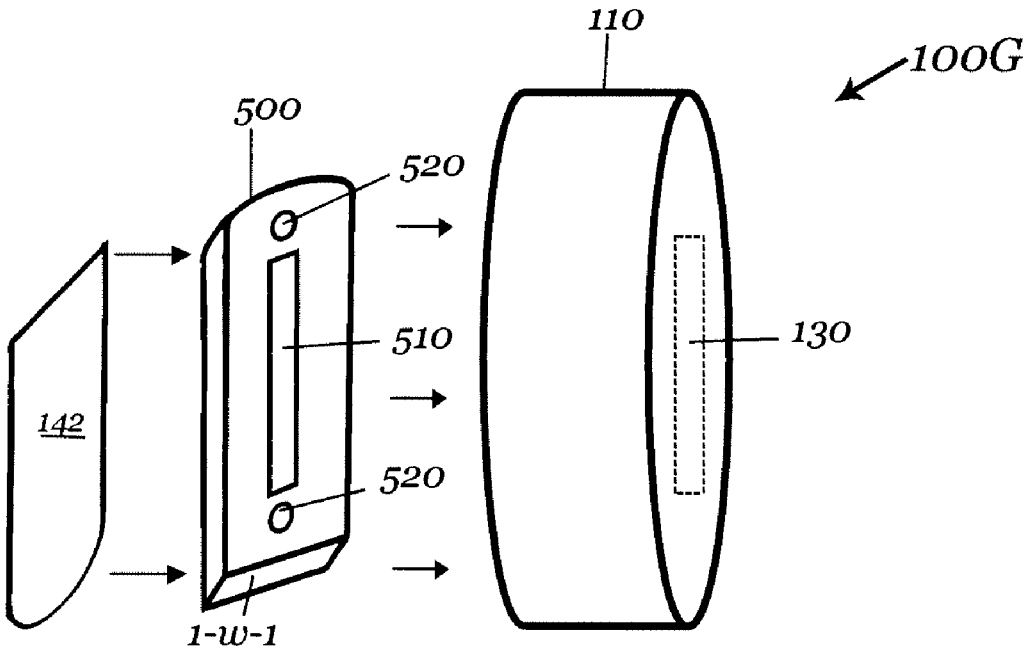
FIG. 11 illustrates another embodiment of a balloon and streamer hub assembly.

FIG. 11 illustrates another embodiment of balloon and streamer hub assembly 100G, which uses an adhesive 142 as previously described. The hub assembly cover 110 contains no mounting holes, but instead has an inside back surface of the cover, shown at area 130, that receives the other side of an adhesive 510 that is attached to a front surface of the mounting block 500. The back surface of the mounting block 500 receives the adhesive 142. Further, the mounting block 500 is shown as having a width "w" that corresponds to the depth of the hub assembly cover, so that attachment of the hub assembly cover 110 to the mounting block 500 is secure. Alternatively, instead of using an adhesive 510, a Velcro® half strip can be used, with the other half of the Velcro® strip being attached to the inside surface of the hub assembly cover 110 at the area 130. Also shown as part of the hub assembly cover mounting block 500 are two optional holes 520, which holes 520 can be used to tie a string through, or drive a nail or screw through, if an alternative attachment mechanism to the adhesive 142 is desired.

Figure 12:
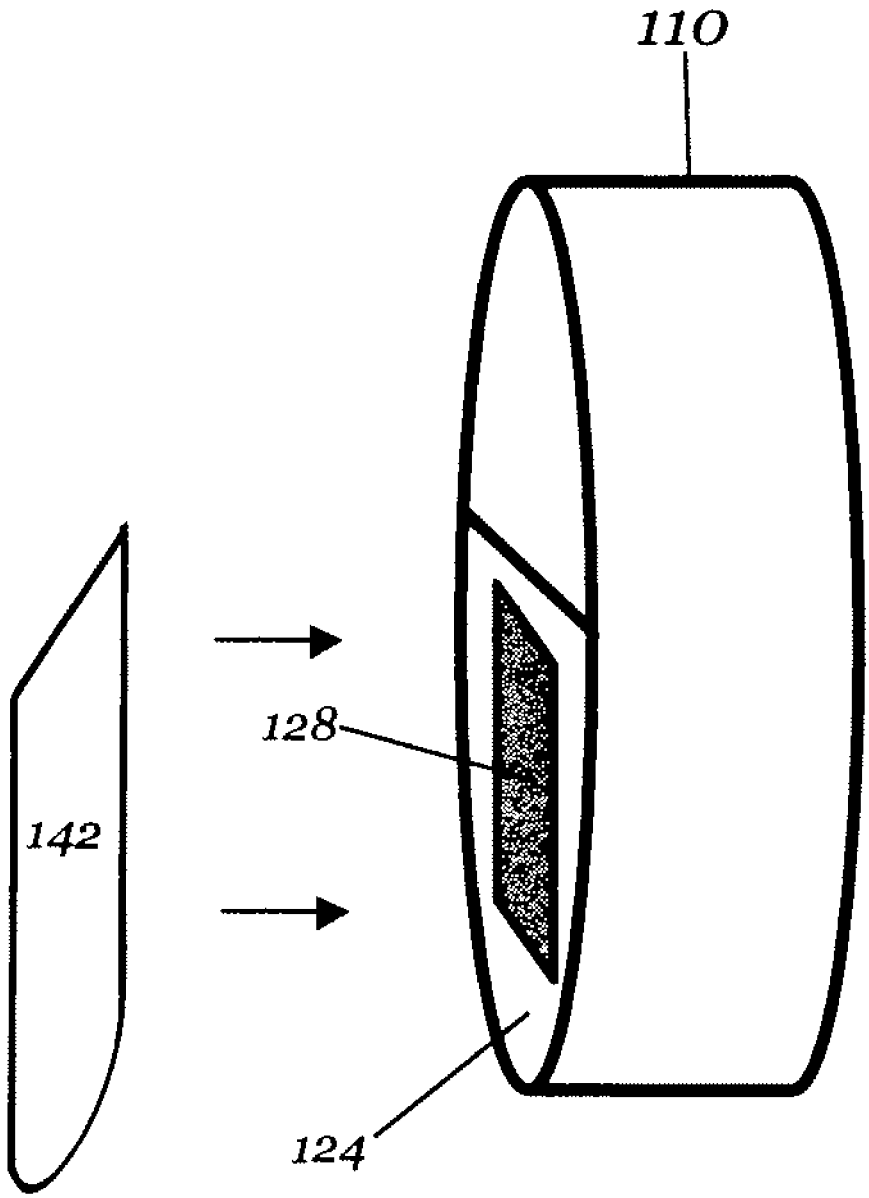
FIG. 12 illustrates another embodiment of a balloon and streamer hub assembly.

FIG. 12 illustrates another embodiment of a balloon and streamer hub assembly 100H, which uses an adhesive 142 as previously described. The hub assembly cover 110 contains no mounting holes, but instead has at least a partial backside 124, with an adhesive mount in area 128, to which the adhesive 142, preferably a Command® strip as referred to previously, can attach.

For each of the above embodiments above where the cover attachment has been described, it is again noted that the holes and opening for insertion of balloons and streamers are not depicted, nor illustrations on the front of the cover 110, for convenience of understanding.

Although the present invention has been particularly described with reference to embodiments thereof, it should be readily apparent to those of ordinary skill in the art that various changes, modifications and substitutes are intended within the form and details thereof, without departing from the spirit and scope of the invention. Accordingly, it will be appreciated that in numerous instances some features of the invention will be employed without a corresponding use of other features. Further, those skilled in the art will understand that variations can be made in the number and arrangement of components illustrated in the above figures. It is intended that the scope of the appended claims include such changes and modifications.

What is claimed is:

1. An assembly attachable to a frame, the assembly comprising:

a plurality of balloons each having a balloon end;

a plurality of streamers each having streamer ends;

a bowl-shaped cover, the bowl-shaped cover having a depth, and wherein the bowl-shaped cover further includes a plurality of holes disposed around peripheral edges thereof in predetermined positions such that at least two holes are disposed in a top half of the bowl-shaped cover and at least two holes are disposed in a bottom half of the bowl-shaped cover, each of the plurality of holes disposed in the top half of the bowl-shaped cover adapted for insertion thereto of the balloon end of one of the plurality of balloons, and each of the plurality of holes disposed in the bottom half of the bowl-shaped cover adapted for insertion thereto of one of the streamer ends of the plurality of streamers, such that each of the balloon ends and each of the streamer ends is disposed within the depth of the bowl shaped cover to thereby become hidden from view; and an adhesive member, the adhesive member having an adhesive surface for attachment to the frame and adapted for being coupled to the bowl-shaped cover.

2. The assembly of claim 1 wherein the bowl-shaped cover has a front face, at least a partial backside, and the depth is between the front face and the partial backside; and wherein the adhesive member attaches to the partial backside of the bowl-shaped cover.

3. The assembly according to claim 2 wherein bowl-shaped cover is a unitary piece of molded plastic.

4. The assembly according to claim 3 wherein the adhesive member is a 3M COMMAND® STRIP adhesive strip.

5. The assembly according to claim 1 further including an adhesive mount, the adhesive mount including a back side onto which the adhesive member is attachable and a front side;

a securing mechanism, for attachment of the bowl-shaped cover to the adhesive mount.

6. The assembly according to claim 5 wherein the securing mechanism is a plurality of cover tabs and associated plurality of slits, wherein each of the plurality of cover tabs project from the adhesive mount, each cover tab having an associated extender, and wherein the bowl-shaped cover includes on a side surface thereof the associated plurality of slits that correspond in location to the plurality of cover tabs, with each slit receiving one associated extender.

7. The assembly according to claim 6 wherein the adhesive mount and the securing mechanism are formed as a unitary piece.

8. The assembly according to claim 7 wherein the unitary piece is molded plastic and wherein the bowl-shaped cover is molded plastic.

9. The assembly according to claim 8 wherein the adhesive member is a 3M COMMAND® STRIP adhesive strip.

10. The assembly according to claim 6 wherein the adhesive mount includes an adhesive mounting block and a mounting bracket;

wherein the adhesive mounting block includes the backside of the adhesive mount and a tab; and wherein the mounting bracket includes the frontside of the adhesive mount, the cover tabs and the associated extenders and further includes a recess, and wherein the mounting bracket attaches to the adhesive mounting block using the tab that inserts into the recess of the mounting bracket.

11. The assembly according to claim 5 wherein the depth of the bowl-shaped cover covers the adhesive mount.

12. The assembly according to claim 1 wherein the bowl-shaped cover has an outer shape that is one of circular and star-shaped.

13. The assembly according to claim 1 further including another bowl-shaped cover that is the same as the bowl-shaped cover and another adhesive member that is the same as the adhesive member, wherein the plurality of streamers is adapted to be hung between the bowl-shaped cover and the another bowl-shaped cover, and wherein the plurality of balloons are also adapted to be disposed from the top half of the another bowl-shaped cover.

14. The assembly of claim 13 wherein the bowl-shaped cover and the another bowl-shaped cover each have a front face, at least a partial backside, and the depth is between the front face and the partial backside; and wherein the adhesive member attaches to the partial backside of the bowl-shaped cover and the another adhesive member attaches to the partial backside of the another bowl-shaped cover.

15. The assembly according to claim 13 wherein bowl-shaped cover and the another bowl-shaped cover are each a unitary piece of molded plastic.

16. The assembly according to claim 15 wherein the adhesive member and the another adhesive member are each a 3M COMMAND® STRIP adhesive strip.

17. The assembly according to claim 15 further including an adhesive mount, the adhesive mount including a back side onto which the adhesive member is attachable and a front side;

a securing mechanism, for attachment of the bowl-shaped cover to the adhesive mount;

another adhesive mount, the another adhesive mount including another back side onto which the another adhesive member is attachable and another front side; and another securing mechanism, for attachment of the another bowl-shaped cover to the another adhesive mount.

18. The assembly according to claim 17 wherein the securing mechanism is a plurality of cover tabs and associated plurality of slits, wherein each of the plurality of cover tabs project from the adhesive mount, each cover tab having an associated extender, and wherein the bowl-shaped cover includes on a side surface thereof the associated plurality of slits that correspond in location to the plurality of cover tabs, with each slit receiving one associated extender; and wherein the another securing mechanism is another plurality of cover tabs and another associated plurality of slits, wherein each of the another plurality of cover tabs project from the another adhesive mount, each cover tab having an associated extender, and wherein the another bowl-shaped cover includes on a side surface thereof the another associated plurality of slits that correspond in location to the another plurality of cover tabs, with each slit receiving one associated extender.

19. The assembly according to claim 18 wherein the adhesive mount and the securing mechanism are formed as a unitary piece and wherein the another adhesive mount and the another securing mechanism are formed as another unitary piece.

20. The assembly according to claim 19 wherein the unitary piece is molded plastic, wherein the bowl-shaped cover is molded plastic, wherein the another unitary piece is molded plastic and wherein the another bowl-shaped cover is molded plastic.

21. The assembly according to claim 20 wherein the adhesive member is a 3M COMMAND® STRIP adhesive strip.

* * * * *